United States Patent [19]

Godbout

[11] Patent Number: 4,490,694

[45] Date of Patent: Dec. 25, 1984

[54] MICROWAVE SWITCH WHEREIN PIN DIODE IS MOUNTED ORTHOGONAL TO MICROSTRIP SUBSTRATE

[75] Inventor: James L. Godbout, San Jose, Calif.

[73] Assignee: Eaton Corporation, Sunnyvale, Calif.

[21] Appl. No.: 402,630

[22] Filed: Jul. 28, 1982

[51] Int. Cl.[3] ..... H01P 1/15

[52] U.S. Cl. ..... 333/104; 333/247

[58] Field of Search ..... 333/103, 104, 238, 246, 333/247, 262, 164, 81 A; 331/107 SL

[56] References Cited

U.S. PATENT DOCUMENTS 3,913,040 10/1975 Rosen et al. ..... 333/247
4,150,345 4/1979 Goldman et al. ..... 333/246 X
4,240,098 12/1980 Zory et al. ..... 333/247 X

*Primary Examiner*—Paul Gensler
*Attorney, Agent, or Firm*—Thomas E. Schatzel

[57] ABSTRACT

An improved microwave multi-throw switch incorporating PIN diodes wherein the PIN diodes are mounted orthogonally to the conductive stripline.

7 Claims, 6 Drawing Figures

MICROWAVE SWITCH WHEREIN PIN DIODE IS MOUNTED ORTHOGONAL TO MICROSTRIP SUBSTRATE

BACKGROUND OF THE INVENTION

1. Field of the Invention

This invention relates generally to microwave switches and more particularly to a multi-throw microwave stripline switch utilizing PIN diodes.

2. Description of the Prior Art

There are various microwave multi-throw switches in the prior art. Such prior art switches include those utilizing striplines with beam lead PIN diodes extending across stripline segments. There are other structures utilizing PIN diodes mounted in a horizontal position with the conductive layer of the diode superimposed on a stripline and the junction lead extending across the gap between striplines to another stripline.

In microwave multi-throw switches, performance is highly dependent upon isolation losses, voltage standing wave ratios and insertion losses. In the known prior art structures the beam lead diodes provide a structure of significant improved performance over that of the conventional PIN diodes in these three operating characteristics. However, the cost to manufacture beam lead PIN diodes is substantially greater than that of the conventional PIN diode.

As a consequence, when operating in the two gigaHertz to eighteen gigaHertz frequency range either beam lead diodes are used exclusively or they are used in combination with a conventional PIN diode.

SUMMARY OF THE PRESENT INVENTION

It is an object of the present invention to provide a microwave multi-throw switch structure which provides electrical operating characteristics comparable to those of beam lead PIN diodes and which are more economical than beam lead PIN diodes.

It is a further object of the present invention to provide a microwave multi-throw switch structure utilizing PIN diodes which provide improved electrical operating characteristics over switches utilizing conventional PIN diodes.

In a preferred embodiment of the present invention, a microwave multi-throw switch incorporates a PIN diode wherein the metalized surface opposite the junction is placed substantially orthogonally to the stripline surface. The metalized surface is electrically and adhesively adhered to the stripline surface by a conductive conduit. Leads from the junction then project directly across the gap of the stripline to the adjacent stripline segment.

An advantage of the present invention is that it provides improved isolation losses over that of microwave switches utilizing conventional PIN diode structures wherein the conductive surface of the diodes are sandwiched to the stripline surface.

A further advantage of the present invention is that it provides improved isolation relative to that of microwave multi-throw switches utilizing conventional PIN diodes with the conductive surface adherently sandwiched to the stripline.

A further advantage of the present invention is that it provides a microwave multi-throw switch wherein the voltage standing wave ratio is superior to that of microwave switches utilizing conventional PIN diode structures with the conductive surface sandwiched to the stripline surface.

These and other objects and advantages of the present invention will no doubt become apparent to those of ordinary skill in the art after having read the following detailed description of the preferred embodiments which are illustrated in the various drawings and figures.

IN THE DRAWINGS

DETAILED DESCRIPTION OF THE PREFERRED EMBODIMENTS

Figure 1:
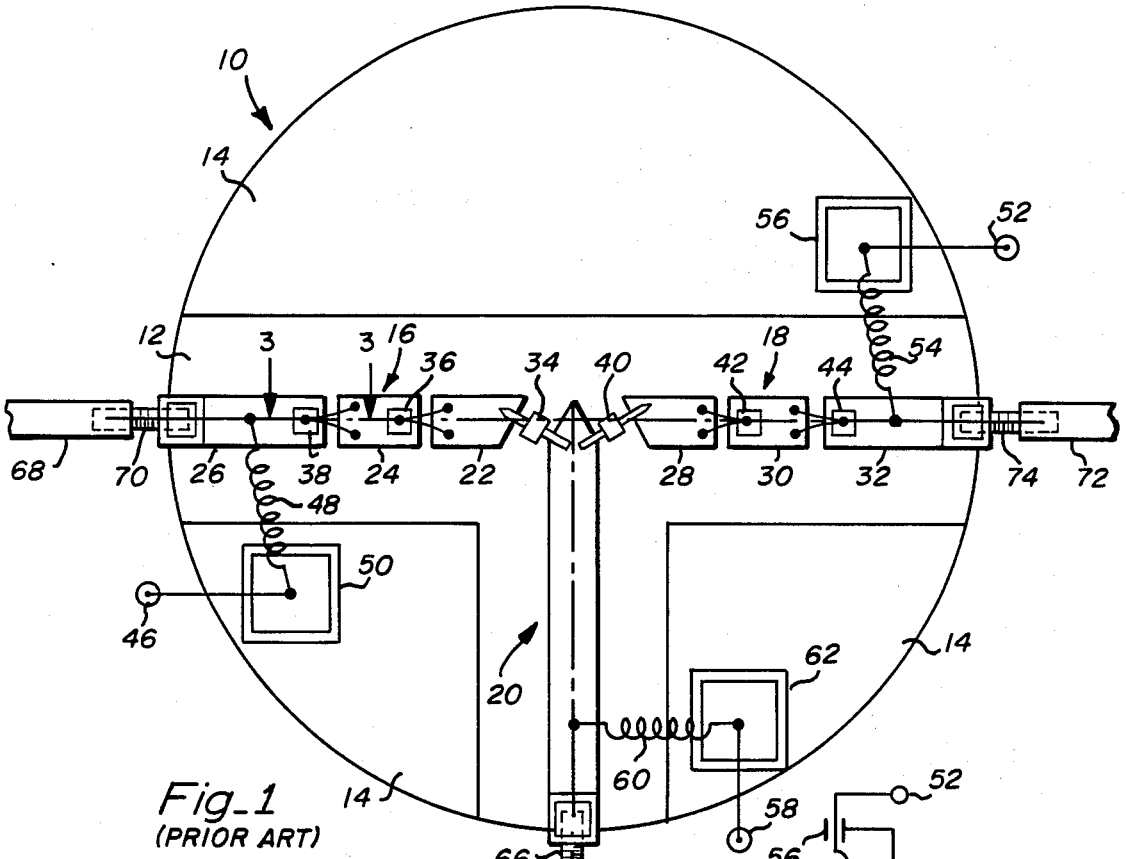
Fig 1 (PRIOR ART)
FIG. 1 is an exploded and enlarged diagrammatic illustration of a single-pole double-throw microwave switch utilizing beam lead diodes and conventional PIN diodes at the junctions.
Figure 2:
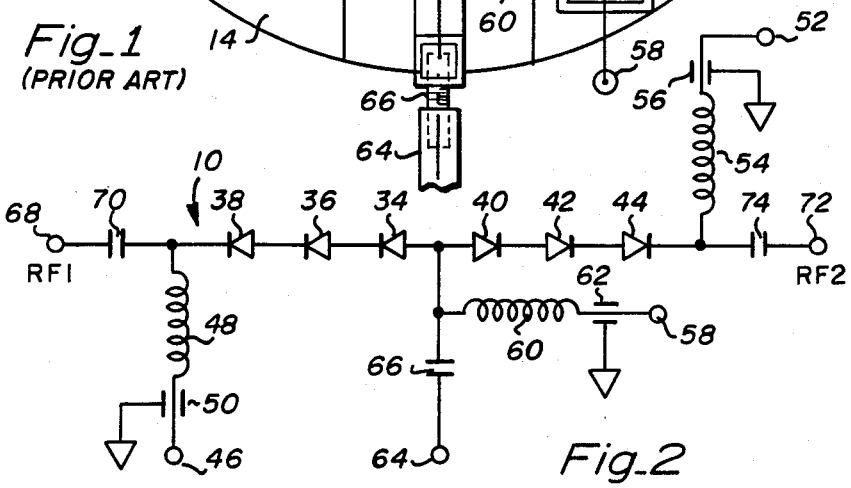
FIG. 2 is an electronic circuit diagram of the switch of FIG. 1.

In FIG. 1 is illustrated a microwave single-pole double-throw switch referred to as general reference character 10. The electrical circuit of the switch 10 is illustrated in FIG. 2. The switch 10 is structured to operate within the two gigaHertz to eighteen gigaHertz frequency range. The switch 10 incorporates an insulative base material 12. About the top and bottom surface of the material base 12 is a conductive metal 14. The conductive metal 14 may be comprised of copper and gold composition. To form the switch panel, portions of the conductive layer are etched away or removed from the insulative surface 12 so as to form (microstrip) striplines on the surface. For example, a first stripline referred to by the general reference character 16, a second stripline referred to by the general reference character 18, and a third stripline referred by the general reference character 20 are formed. As illustrated, the stripline 16 is comprised of various segments illustrated as 22, 24 and 26. The stripline 18 is comprised of a plurality of segments 28, 30 and 32. Line 20 is comprised of one segment. Thus, the stripline 20 establishes the common line to the switch with the striplines 16 and 18 forming the key different throws for the switch. Interconnecting the common line 20 to the segment 22 is a beam lead diode 34. Connecting the stripline segment 22 to the segment 24 is a conventional PIN diode structure 36. Likewise interconnecting the segments 24 and 26 is a conventional PIN diode structure 38.

Connecting the common line 20 to the junction 28 of the segment 18 is a beam lead diode 40. Interconnecting the segments 28 and 30 is a conventional PIN diode 42. Interconecting the segments 30 and 32 is a conventional PIN diode 44.

Stripline segments 16, 18 and 20 are generally in the form of fifty-ohm transmission line structures. These structures are all biased. For example, the line 16 is biased by means of a bias applied to a bias terminal 46 which is common to an inductive element 48 and to one plate of a capacitor 50. The element 48 is tied to the stripline segment 26 and the other side of the capacitor 50 is adhered to the metal 14 which is the common ground reference. Likewise, the stripline 18 is biased by means of a bias applied to a bias terminal 52 which is tied to an inductor 54 extending to the segment 32. The inductor 54 is common to a capacitor 56 of which one side is adhered to the metal 14 which is a common ground.

The common segment 20 is biased by a source applied to the bias terminal 58 which is common to the inductor 60 extending to the line 20. Also, the capacitor 62 has one side common to the metalized surface 14 which is common ground reference.

The switch 10 is tied to an incoming line 64 through a capacitive element 66. The capacitive element 66 adheres to the input line from the exterior to the stripline 20.

The output from the line 16 is taken to an output line 68 through a capacitive element 70 which is adhered to the exterior line 68 and the stripline 16.

The stripline element 18 is tied to the exterior line 72 through a capacitive element 74 which is adhered to the line 18 and the exterior line 72.

Figure 3:
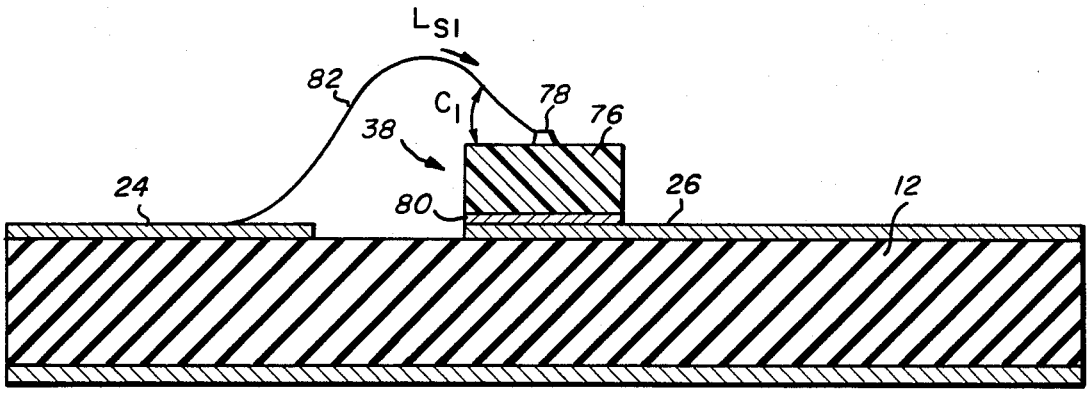
Fig 3 (PRIOR ART)
FIG. 3 is a cross-section and further enlarged view of a conventional PIN diode-stripline structure.

In the illustrated embodiment the conventional type PIN diodes are shown as 36, 38, 42 and 44. FIG. 3, is an enlarged cross-sectional view of the diode 38 taken along the line 3—3. The diode 38 includes a silicon chip 76. Generally, this chip is in the form of a rectangular member with a junction 78 about the top horizontal surface and a metalized coating 80 on the bottom surface opposite to the junction. The junction 78 is connected by a lead wire 82 across the gap of the segment 24 to the segment 26. Thus, when the segment 16 is biased, current can flow through the diode 38 intermediate the plate 80 and junction 78 and through the lead 82. At the high microwave frequencies, for example in the two gigaHertz to eighteen gigaHertz range, there are losses due to the stray capacitance between the lead 82 and the silicon member 76. For example, this is illustrated in FIG. 3 as "$C_1$". Also, the line 82 has inductance $L_{s1}$. At the microwave frequencies, these inductances and capacitances create capacitive and inductive losses. These features cause for isolation losses, insertion losses and voltage standing wave ratio losses. Thus, performance wise, it becomes desirous to minimize such losses and at the least economical cost. One way in which to decrease these undesirable characteristics is to utilize beam lead PIN diodes such as illustrated by the PIN diodes 34 and 40. However, the economic cost of such diodes impairs the desirability of such diodes. Frequently, it becomes a matter of trade-off between economics and operating characteristics whether to use beam lead diodes.

Figure 4:
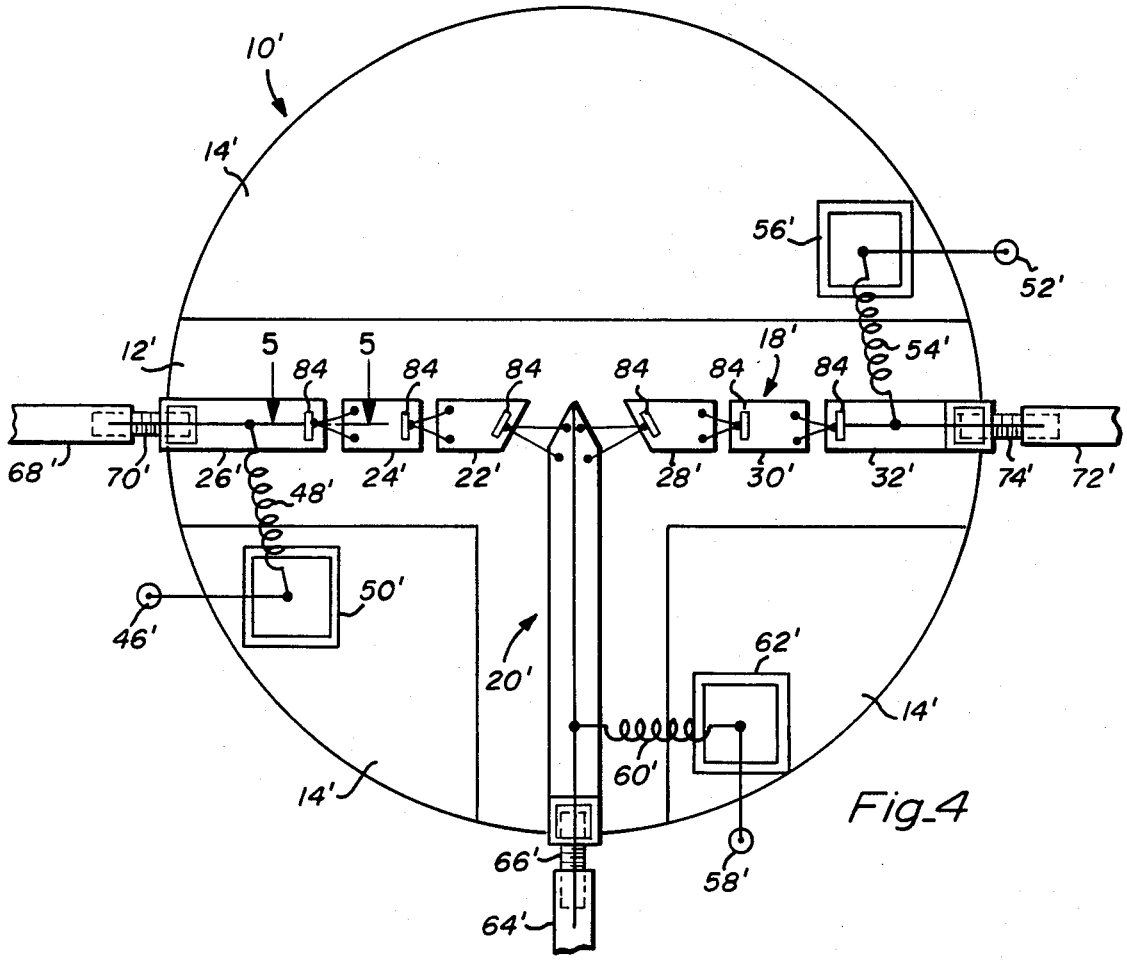
FIG. 4 is an enlarged diagrammatic illustration of a microwave single-pole double-throw switch utilizing diodes in a structure of the present invention.
Figure 5:
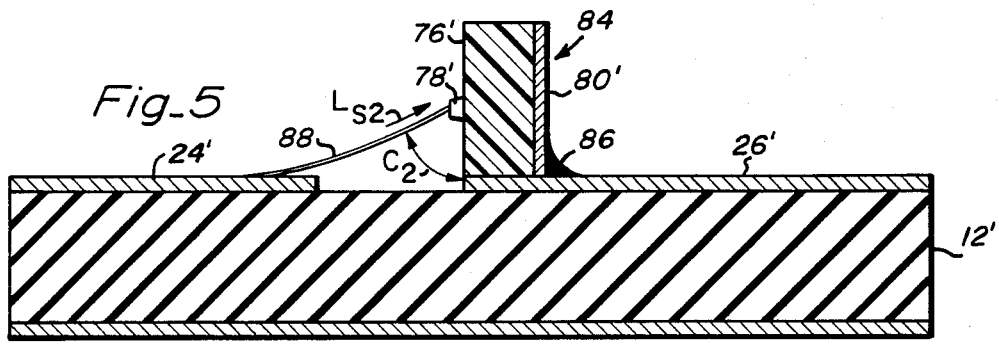
FIG. 5 is a cross-section enlarged view of a PIN diode mounted on a stripline in accordance with the present invention.

FIGS. 4 and 5 illustrate an improved structure as represented by the present invention. In FIG. 4 a microwave single-pole double-throw switch similar to that of FIG. 1 is illustrated but wherein improved PIN diodes are utilized. For clarity and convenience, the elements of FIGS. 4 and 5 common to those of FIGS. 1 and 3 utilize the same reference numeral distinguished by a prime designation. In FIG. 4, all of the segments of the striplines 16', 18' and 20' are interconnected by a PIN diode 84. A cross-sectional view of one of the diodes 84 and interconnecting the segments 24' and 26' is illustrated in FIG. 5, which is taken along lines 5—5 in FIG. 4. The diodes 84 are similar to the diode 38 in that they incorporate a silicon substrate 76', a junction 78' and a conductive layer 80'. However, as illustrated in FIG. 5, the conductive layer 80' is substantially orthogonal to the stripline 24'. The conductive layer 80' is conductively adhered to the stripline 24' by a conductive conduit 86. In FIG. 5, this conductive conduit is in the form of a silver epoxy or a gold epoxy. The junction 78' is connected to the stripline 26' by a conductive line 88. The line 88 extends directly from the junction 78' to the layer 26'. As such, it is substantially shorter in length than the line 82 of FIG. 3. Furthermore, the line 88 has very little, if any, overlap with the silicon substrate 76' such that the only significant stray capacitance is that between the line 88 and the stripline 24'.

Figure 6:
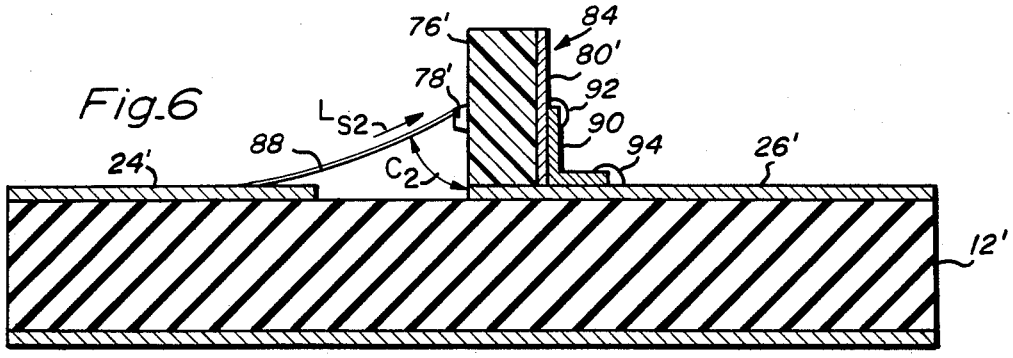
FIG. 6 is an enlarged cross-sectional view of an alternative embodiment of a structure of a PIN diode of the present invention.

An alternative embodiment of the structure of the diode 84 is illustrated in FIG. 6. In FIG. 6 the surface 80' is connected to a conductive bracket 90. One end of the bracket 90 is adhered to the conductive layer 80' by means of a solder joint 92 and the other end is connected to the stripline 24' by means of a solder joint 94. Basically, the differences between the diode 84 of FIG. 5 and 84 of FIG. 6 is the means in which it is amounted to the striplines 24'.

To comparatively illustrate the electrical characteristics of the diode structure 38 of FIG. 3 to the diode structure 84 of FIGS. 5 or 6, a mathematical comparison may be made. First, viewing the structure 38 and letting $L_1$ represent the inductance per inch and h represent the length of the wire 82, then assuming the inductance is 5.08 nh per inch, and the length is 0.03 inches, the inductance $$L_{si} = 5.08\ (0.030);$$

$$= 0.15\ nH.$$

At a frequency (f) of 18 GHz, $$X_L = L = 0.94 \text{ ohms.}$$

For four diodes, $X_L = 3.76$ ohm which is approximately 1 db of insertion loss.

The stray capacitance $C_1$ may be viewed as, $$C_1 = \epsilon A/d = \epsilon \times (0.005 \times 10^{-3})/(0.002) = \epsilon \times (2.5 \times 10^{-3}), = 22.12 \times 10^{-15} \text{farads} = 0.022 \text{ pf,}$$

where A is the cross sectional area of lead 82 ($0.005 \times 10^{-3}$) and where d is the average separation between lead 82 and silicon chip 76 (0.002) (obtained by physical measurements and verified by microwave measurements).

At 18 GHz the equivalent circuits $$C_T = C_j + C_1;$$

where $C_j = 0.02$ pf, $C_j$ being the diode 38 junction capacitance;

$$C_T = 0.044 \text{ pf;}$$

and has a 10 db isolation.

Therefore, for a four diode switch, the total isolation is approximately 40 decibels.

As to the structure 84 using the same type wire, but of approximately one-fourth the length, then the inductance of the wire 88

$$L_{s2} = 5.08\ (0.008)$$

-continued $= 0.04\ nH.$

At a frequency (f) of 18 GHz;

$$X_L = L = 0.25 \text{ ohms.}$$

For four diodes $X_L = 1.00$ ohms which is approximately 0.2 db of insertion loss.

The stray capacitance $C_2$ may be viewed as, $$C_2 = \epsilon A/d = \epsilon \times (0.001 \times 10^{-3})/(0.0056) = \epsilon \times (0.17 \times 10^{-3}) = 1.5 \times 10^{-15} \text{ farads} = 0.0015 \text{ pf,}$$

where A is the cross sectional area of lead 88 $(0.001 \times 10^{-3})$ and where d is the average separation between lead 88 and silicon substrate 76'.

At 18 GHz, the equivalent circuit $$C_T = C_j + C_2;$$

where $C_j = 0.02$ pf, $C_j$ being the diode 84 junction capacitance;

$$C_T = 0.0215 \text{ pf;}$$

and has a 14 db isolation.

Thus, for a four diode switch, the total isolation is approximately 56 db.

Therefore, the structure 38 of FIG. 3 has approximately 40 decibel isolation and 3.4 decibel insertion loss; whereas the structure 84 has approximately 56 decibel isolation and 2.6 decibel insertion loss.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. An improved microwave multi-throw switch comprising:

a support structure for insulatively supporting a plurality of stripline segments;

a first conductive stripline aligned along a first common path on said structure;

a second conductive stripling aligned along a second common path on said structure and insulated from the first conductive stripline;

a common conductive stripline aligned along a third common path on said structure insulated fron the first and second striplines; and at least one PIN diode having a junction on one surface and a conductive layer on the opposite surface, the PIN diode being mounted on the structure along at least one of said paths with the conductive layer surface substantially orthogonal to the stripline of said one path and adhered thereto through a conductive conduit, the junction of the diode being adhered to a conductive lead means which extends to the stripline of another one of said paths.

2. An improved microwave multi-throw switch of claim 1 wherein, the first conductive stripline includes a plurality of individual aligned segments insulated relative to one another; and the PIN diode being mounted on one of said segments with said conductive layer surface being adhered to said segment by said conductive conduit and said conductive lead means extending to and adhered to said adjacent segment.

3. An improved microwave multi-throw switch of claim 1 wherein, the first conductive stripline includes a plurality of individual aligned segments insulated relative to one another;

the second conductive stripline includes a plurality of individual aligned segments insulated relative to one another; and a plurality of PIN diodes, with one of said diodes being mounted on one of said segments of said first stripline with said conductive layer surface of said one diode being adhered thereto and another of said diodes being mounted on one of said segments of said second stripline with said conductive layer surface of said other diode being adhered thereto.

4. An improved microwave multi-throw switch of claim 1 wherein, said conductive conduit is a conductive epoxy.

5. An improved microwave multi-throw switch of claim 4 wherein, said conductive conduit is silver epoxy.

6. An improved microwave multi-throw switch of claim 4 wherein, said conductive conduit is gold epoxy.

7. An improved microwave multi-throw switch of claim 4 wherein, said conductive conduit is a conductive bracket with one end thereof adhered to said conductive layer and another end adhered to said stripline.

* * * * *